US005827102A

United States Patent [19]

Watkins et al.

[11] Patent Number: 5,827,102

[45] Date of Patent: Oct. 27, 1998

[54] LOW TEMPERATURE METHOD FOR EVACUATING AND SEALING FIELD EMISSION DISPLAYS

[75] Inventors: Charles M. Watkins, Boise; Danny Dynka, Meridan, both of Id.

[73] Assignee: Micron Technology, Inc., Boise, Id.

[21] Appl. No.: 645,059

[22] Filed: May 13, 1996

[51] Int. Cl.[6] ..... H01J 9/26

[52] U.S. Cl. ..... 445/25; 445/43

[58] Field of Search ..... 445/24, 25, 43; 228/115, 116

[56] References Cited

U.S. PATENT DOCUMENTS

| | | | |
|---|---|---|---|
| 2,882,116 | 4/1959 | Williams | 445/43 |
| 3,090,116 | 5/1963 | Burgess | 445/43 X |
| 4,005,920 | 2/1977 | Wimmer | 316/19 |
| 4,018,374 | 4/1977 | Lee et al. | 445/45 |
| 4,204,721 | 5/1980 | Hubert et al. | 445/25 |
| 4,268,712 | 5/1981 | Overall | 445/25 |
| 4,709,122 | 11/1987 | Samuels | 174/52 |
| 5,205,770 | 4/1993 | Lowrey et al. | 445/24 |
| 5,210,472 | 5/1993 | Casper et al. | 315/349 |
| 5,229,331 | 7/1993 | Doan et al. | 437/228 |
| 5,302,238 | 4/1994 | Roe et al. | 156/643 |
| 5,563,470 | 10/1996 | Li | 445/24 X |
| 5,697,825 | 12/1997 | Dynka et al. | 445/43 X |

OTHER PUBLICATIONS

Leppo, Marion et al., *Electronic Materials Handbook*, vol. 1 Packaging, 1989, pp. 203–205.

Meyer, R., "6" Diagonal Microtips Fluorescent Display for T.V. Applications", LETI/DOPT CENG, Euro display 1990, pp. 374–377.

Vaudaine, R., "'Microtips' Fluorescent Display", IEDM, 1991.

Glass Panel Alignment and Sealing for Flat Panel Displays, Sandia National Laboratory, Colorado, Program Summary, Dec. 1994.

Zimmerman, Steven et al., Flat Panel Display Project Presentation, Sandia National Laboratories, Technical Information Exchange Workshop, Nov. 30, 1994.

Tummala, Rao R., *Microelectronics Packaging Handbook*, pp. 736–755, 1989.

Cathey, David A. Jr., "Field Emission Displays", VLSI, Taiwan, May–Jun., 1995.

*Primary Examiner*—Kenneth J. Ramsey
*Attorney, Agent, or Firm*—Stephen A. Gratton

[57] ABSTRACT

A method for evacuating and sealing a field emission display package and an improved field emission display package are provided. The field emission display package includes a face plate, a back plate and a peripheral seal formed between the face plate and back plate of a low melting point seal material such as indium or an alloy of indium. Within the sealed package components of a field emission display are mounted. These include a display screen formed on the face plate and a base plate flip chip mounted to the face plate. The peripheral seal is formed during a sealing and evacuating process performed in a reaction chamber at a reduced pressure. During the sealing and evacuating process the seal material is compressed. In addition, the sealing and evacuating process can be performed at approximately room temperature or alternately at temperature near the softening point of the seal material.

16 Claims, 2 Drawing Sheets

LOW TEMPERATURE METHOD FOR EVACUATING AND SEALING FIELD EMISSION DISPLAYS

FIELD OF THE INVENTION

This invention relates generally to field emission displays and particularly to an improved low temperature process for evacuating and sealing field emission display packages.

BACKGROUND OF THE INVENTION

Flat panel displays have recently been developed for visually displaying information generated by computers and other electronic devices. These displays can be made lighter and require less power than conventional cathode ray tube displays. One type of flat panel display is known as a cold cathode field emission display (FED).

A field emission display uses electron emissions to illuminate a cathodoluminescent display screen and generate a visual image. An individual field emission pixel typically includes a face plate wherein the display screen is formed and emitter sites formed on a base plate. The base plate includes the circuitry and devices that control electron emission from the emitter sites. For example, a gate electrode structure, or grid, is associated with the emitter sites. When a voltage differential is established between the emitter sites and grid, electron emission is initiated. The emitted electrons pass through a vacuum space and strike phosphors contained on the display screen. The phosphors are excited to a higher energy level and release photons to form an image. In this system the display screen is the anode and the emitter sites are the cathode.

The emitter sites and face plate are spaced apart by a small distance to stand off the voltage differential and to provide a gap for gas flow. In order to achieve reliable display operation during electron emission, a vacuum on the order of $10^{-6}$ Torr or less is required. The vacuum is formed in a sealed space contained within the field emission display.

In the past, field emission displays have been constructed as a sealed package. For example, the base plate and face plate can be sealed together directly. Additional plates such as a back plate can also be used to form a sealed package. The seal for the package has typically been formed of a glass frit or other material that must be fired at a relatively high temperature (e.g., 400° C. or greater). In addition, these high sealing temperatures must be maintained for relatively long periods (e.g., hours). This large thermal budget can have an adverse affect on some components of a field emission display. For example, circuit elements associated with the integrated circuitry for the emitter sites are formed of various materials having different coefficients of thermal expansion. Heating to high temperatures for long periods can cause stress failures in these elements. Furthermore, at temperatures of about 600° C., amorphous silicon emitter sites can become polysilicon and generate grain boundaries and oxide fissures. This can cause deformed and asymmetrical emitter sites resulting in non-uniform emissivity characteristics and poor resolution.

In addition, high temperature sealing processes can completely preclude the use of some materials in fabricating field emission displays. As an example, float glass materials used to construct base plates have relatively low strain and softening temperatures. With float glass, significant strain occurs at about 500° C. and significant softening occurs at about 700° C. Therefore, high sealing temperatures cannot be used with these materials.

A further problem with high temperature sealing processes is that alignment of the components of the field emission display must be performed and maintained at temperature. It would be advantageous to be able to perform these functions at relatively lower temperatures.

It would also be advantageous to be able to seal a field emission display package without the requirement of an external tube for evacuating the package. An evacuation tube must be sealed after evacuation and represents a potential source of failure during the lifetime of the device. Moreover, the protrusion of the tube from the display package is inconvenient and must be accommodated during packaging of the display package into a system, such as a lap top computer.

SUMMARY OF THE INVENTION

In accordance with the present invention, an improved low temperature method for evacuating and sealing field emission display packages and an improved field emission display package are provided. The field emission display package includes a face plate, a back plate and a peripheral seal formed of a low melting point material such as indium or an alloy of indium.

During a sealing and evacuating process, the peripheral seal is formed between the face plate and the back plate, and a sealed space is formed by the peripheral seal and evacuated. Initially, the face plate and the back plate are pre-assembled as sub-assemblies. During the pre-assembly, a display screen is formed on the face plate. In addition, a base plate for a field emission display is flip chip mounted to the face plate. The display screen and the base plate are constructed to form a visual image that is viewable through the face plate of the package. A getter material can be mounted within the package for subsequent activation using an external energy source such as a laser or RF energy.

Formation of the peripheral seal and evacuation of the package can be performed in a reaction chamber at a reduced pressure. During the sealing and evacuating process, the temperature of the reaction chamber can remain relatively low (e.g., 50° C.–75° C.) or the temperature of the reaction chamber can be increased above the softening point of the seal material (e.g., above 125° C.). Also during the sealing and evacuating process, the pressure within the reaction chamber can be reduced to between about $1.0\times10^{-5}$ to $1.0\times10^{-8}$ Torr. In addition, a compressive force can be applied to the plates of the package to extrude the seal material. Initially, the seal material does not totally conform to the sealing surfaces and gaps are present. The gaps provide a flow path for evacuation but eventually close as the seal material extrudes and the peripheral seal is formed.

BRIEF DESCRIPTION OF THE PREFERRED EMBODIMENT

Figure 1:
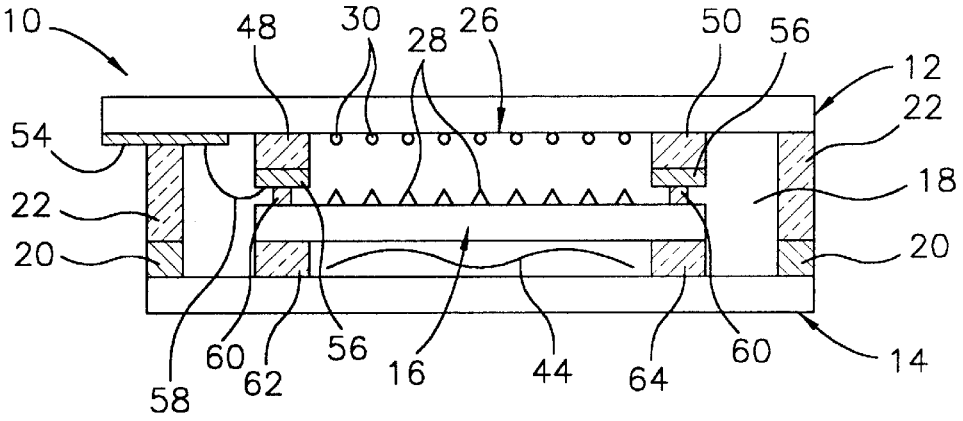
FIG. 1 is a schematic cross sectional view of a field emission display package constructed in accordance with the invention.

Referring now to FIG. 1, a field emission display package 10 constructed in accordance with the invention is shown.

The field emission display package 10 includes a transparent face plate 12 and a back plate 14. In addition, a base plate 16 is mounted between the face plate 12 and the back plate 14 in an evacuated sealed space 18. A low temperature peripheral seal 20 is formed between the face plate 12 and back plate 14 on a frit seal perimeter 22.

Within the display package 10 components of a field emission display are mounted. A display screen 26 is formed on an inside surface of the face plate 12. The face plate 12 is transparent so that the display screen 26 is viewable through the face plate 12. The base plate 16 includes field emitter sites 28 that operate as will be further described to produce a visual image at the display screen 26. The display package 10 also includes a getter material 44. Following the evacuation process the getter material 44 can be activated using a laser beam or RF energy. Once activated, the getter material 44 functions to decrease the pressure within the sealed space 18 throughout the lifetime of the display package 10.

Figure 2:
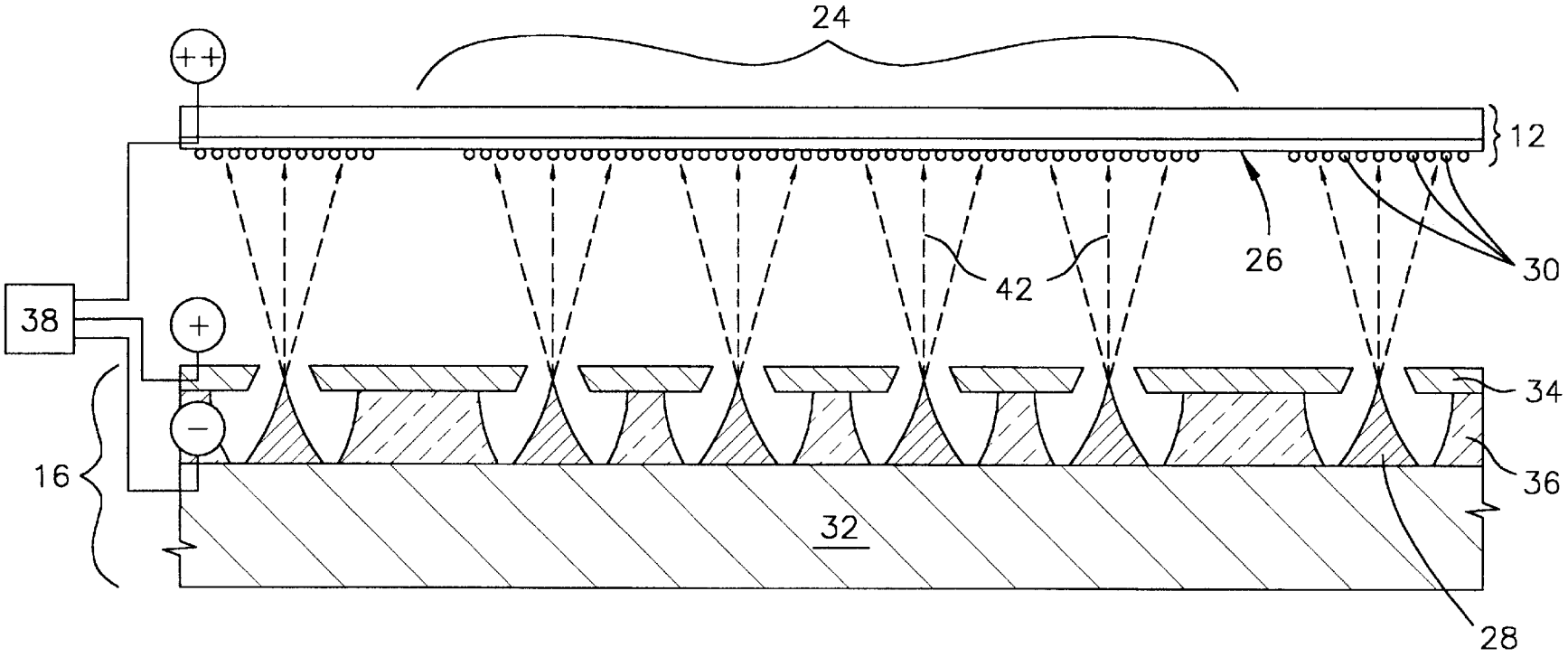
FIG. 2 is an enlarged schematic cross sectional view of the face plate and base plate components for the field emission display package shown in FIG. 1.

With reference to FIG. 2, an enlarged view of a display segment 24 for the field emission display package 10 is shown. Each display segment 24 is capable of displaying a pixel of an image (or a portion of a pixel). The display screen 26 includes phosphors 30 in electrical contact with a transparent conductive layer 46 formed of material such as indium oxide, tin oxide or indium tin oxide.

The base plate 16 is formed as a die similar in construction to a semiconductor integrated circuit die. The base plate 16 includes a substrate 32, formed of a material such as single crystal silicon or alternately, amorphous silicon deposited on a glass substrate. Rows and columns of field emitter sites 28 are formed superjacent to substrate 32 in alignment with the phosphors 30 on the display screen 26. A grid 34 surrounds the emitter sites 28 and is electrically insulated and spaced from the substrate 32 by an insulating layer 36.

Still referring to FIG. 2, a source 38 is electrically connected to the emitter sites 28, to the grid 34 and to the display screen 26. When a voltage differential is applied by the source 38, a stream of electrons 42 is emitted by the emitter sites 28 towards the display screen 26. In this system the display screen 26 is the anode and the emitter sites 28 are the cathode. The electrons 42 emitted by the emitter sites 28 strike the phosphors 30 of the display screen 26. This excites the phosphors 30 to a higher energy level. Photons are released as the phosphors 30 return towards their original energy level.

U.S. Pat. No. 5,302,238 to Roe et al.; U.S. Pat. No. 5,210,472 to Casper et al.; U.S. Pat. No. 5,232,549 to Cathey et al.; U.S. Pat. No. 5,205,770 to Lowrey et al.; U.S. Pat. No. 5,186,670 to Doan et al.; and U.S. Pat. No. 5,229,331 to Doan et al.; all of which are incorporated by reference disclose methods for forming field emission displays including the above components.

Figure 1A:
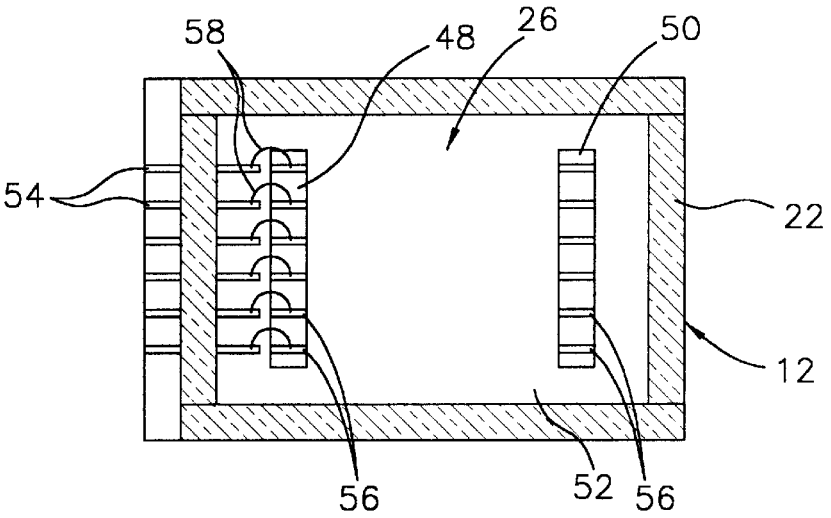
FIG. 1A is a schematic bottom view of a face plate component of the field emission display package shown in FIG. 1.

Prior to the sealing and evacuation process, the face plate 12 is pre-assembled as shown in FIG. 1A. The face plate 12 is formed of a rectangular sheet of a transparent glass material such as Corning 7059 glass. Initially frit rails 48, 50 are attached to the inside surface 52 of the face plate 12. The frit rails 48, 50 can be applied as a viscous paste by screen printing, stenciling or extrusion of glass frit to the face plate 12. This viscous material is then fired to form a permanent bond. As will be further explained, the frit rails 48, 50 are for flip chip mounting the base plate 16 to the face plate 12 and must be able to maintain their structural integrity through subsequent temperature cycles. In addition, the glass frit preferably has a coefficient of thermal expansion (CTE) that closely matches that of the face plate 12. One suitable glass frit is commercially available from Nippon Electric Glass America, Inc. and is designated as LS-0104. This glass frit can be fired by heating to a temperature of about 300°–500° C.

As also shown in FIG. 1A, a pattern of conductive traces 54 is formed on the inside surface 52 of the face plate 12. The pattern of conductive traces 54 can be formed of a thick film conductive material using screen printing or other suitable deposition process (e.g., evaporation, sputtering). In addition, the conductive traces 54 can be insulated by deposition of a suitable insulating layer (e.g., polyimide, $Si_3N_4$).

Still referring to FIG. 1A, the display screen 26 is formed on the inside surface 52 of the face plate 12. As previously explained, the display screen 26 includes the phosphors 30 (FIG. 2) and the transparent conductive layer 46 (FIG. 2). These components can be formed using well known techniques (e.g., PVA/AD slurry, brush, electrophoresis). Bond wires 58 are wire bonded to the bonding pads 56 on the frit rail 48 and to corresponding bonding sites on the conductive traces 54. To facilitate wire bonding, the bonding pads 56 on the frit rail 48 and conductive traces 54 on the face plate 48 can be formed with a metallurgy that is suitable for wire bonding. Wire bonding can be effected using conventional wire bonding apparatus manufactured by Kulicke and Soffa, Inc. and others.

Still referring to FIG. 1A, the frit seal perimeter 22 is also formed during pre-assembly of the face plate 12. The frit seal perimeter 22 comprises four or more glass bars that are placed on the face plate 12 and over the conductive traces 54. The glass bars are bonded to the face plate 12 using a glass frit as previously described so that the frit seal perimeter 22 forms a gas tight seal with the face plate 12. A thickness of the frit seal perimeter 22 is about 0.050 to 0.150 inches.

Following formation of the frit seal perimeter 22 and as shown in FIG. 1, the base plate 16 is aligned and flip chip mounted to the face plate 12. Alignment of the base plate 16 and face plate 12 can be accomplished using an aligner bonder tool used for flip chip mounting semiconductor dice to a circuit board or other substrate. The face plate 12 and the base plate 16 can be provided with alignment fiducials to assist in the alignment process. One suitable aligner bonder tool is disclosed in U.S. Pat. No. 4,899,921 to Bendat et al. and is commercially available from Research Devices, Inc., Piscataway, N.J.

For bonding the base plate 16 to the face plate 12 and making an electrical connection therebetween, the base plate 16 can be formed with bumped bond pads 60. The bumped bond pads 60 are formed on the base plate 16 in electrical communication with various other electrical components such as the emitter sites 28 (FIG. 2) and grid 34 (FIG. 2). The bumped bond pads 60 can be formed out of a solderable material such as a tin-lead solder or out of a pure metal such as gold, silver or aluminum. The bumped bond pads 60 on the base plate 16 can be bonded to the bonding pads 56 on the frit rails 48, 50 using heat and pressure. During the bonding process the bumped bond pads 60 and bonding pads 56 are heated to a temperature of about 350° to 400° C. and pressed together with a force of about 3 to 5 kilograms. This pressure can be applied using a weighted alignment jig or other suitable arrangement.

Figure 1B:
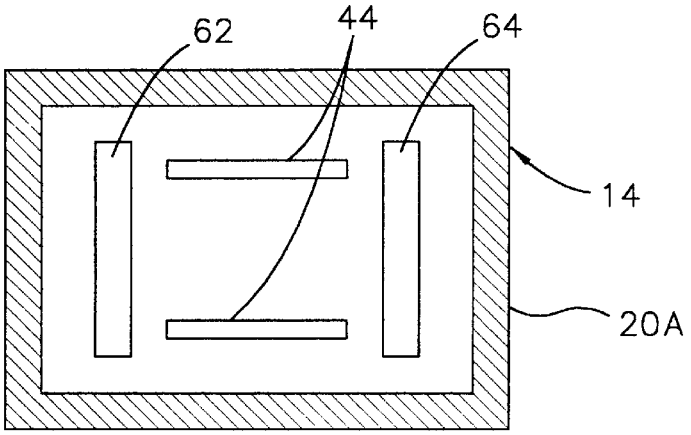
FIG. 1B is a schematic plan view of a back plate component of the field emission display package shown in FIG. 1.

Referring now to FIG. 1B, the pre-assembled back plate 14 is shown. The back plate 14 is formed of a rectangular sheet of a transparent glass material such as Corning 7059 glass. The back plate 14 includes a pair of frit rails 62, 64 that correspond to the frit rails 48, 50 formed on the face plate 12. The frit rails 62, 64 can be formed of glass frit bonded to the back plate 14 as previously described for frit rails 48, 50 for the face plate 12. As shown in FIG. 1, in the assembled field emission display package 10 the frit rails 62, 64 abut the base plate 16 to prevent vertical movement and help to maintain the bond between the base plate 16 and bonding pads 56 on the frit rails 48, 50.

The pre-assembled back plate 14 also includes strips of a getter material 44. The getter material 44 can be formed as strips of metal foil, such as aluminum or steel, that are coated with a getter compound. The getter compound can typically be a titanium based alloy that functions to trap and react with gaseous molecules. Metallic particulates deposited on a metal foil which become reactive when heated are commercially available from various manufacturers. One suitable product is marketed by SAES and designated a type ST-707 getter strip.

Still referring to FIG. 1B, the pre-assembled back plate 14 also includes a low temperature seal material 20A that is applied to the back plate 14 in a peripheral pattern. The peripheral outline of the seal material 20A matches that of the frit seal perimeter 22 (FIG. 1A) formed on the face plate 12. In the illustrative embodiment, the thickness of the seal material as originally applied is about 0.020 to 0.050 inches.

As is apparent, the seal material 20A need not be applied to the back plate 14 but can be applied directly to the frit seal perimeter 22. As another alternative the frit seal perimeter 22 can be eliminated and the seal 20 can be formed directly between the face plate 12 and back plate 14.

The seal material 20A is formed of pure indium or of a low melting point alloy that includes indium (e.g., indium/nickel, indium/tin, indium/lead, indium/silver). Indium is available as a foil in standard thicknesses (e.g., 0.030 inches). Indium melts at a temperature of about 156° C. and softens well below this temperature (e.g., 125° C.) such that the peripheral seal 20 (FIG. 1) can be formed at a relatively low temperature. In addition, indium has an affinity for glass and can be applied to glass at room temperature with good adhesion. Indium also is an inert material that will not produce byproducts that will adversely affect the operation of the field emission display package 10.

A wetting agent, such as a metal film (e.g., AgCr) can be applied to the back plate 14 in a peripheral pattern matching that of the frit seal perimeter 22 to aid in adhesion of the seal material 20A to the back plate 14. The wetting agent can be applied using a thin film deposition process such as evaporation or sputtering.

With the back plate 14 pre-assembled, the back plate 14 can be aligned with the pre-assembled face plate 12 and the seal material 20A on the back plate 14 placed into contact with the frit seal perimeter 22 on the face plate 12. A clamp or weighted jig (not shown) can be used to maintain the back plate 14 and face plate 12 in alignment and to apply a compressive force. Typically, this compression force will be on the order of 200 to 1000 gms.

The aligned and clamped back plate 14 and face plate 12 are then placed in a reaction chamber to evacuate and outgas the package and form the peripheral seal. This process can be performed in a reaction chamber of a vessel formed of an inert material such as quartz or stainless steel. By way of example, the reaction chamber can be a diffusion furnace or a low pressure chemical vapor deposition (LPCVD) furnace used in semiconductor fabrication. These types of furnaces can be heated to temperatures of from 100°–600° C. and evacuated using suitable pumps to pressures of less than $10^{-8}$ Torr.

One suitable heating and evacuation sequence begins as follows. Initially the package 10 is placed in the reaction chamber and a vacuum is created in the reaction chamber using vacuum pumps (e.g., $1.0\times10^{-5}$ to $1\times10^{-8}$ Torr). At the same time, the reaction chamber is initially maintained at a relatively low temperature that is well below the melting point of the seal material 20A (e.g., 50° C.–75° C.). The package 10 is allowed to soak at this temperature and pressure for a time period (e.g., 1–2 hours) sufficient to reach equilibrium and outgas water and other contaminants from the reaction chamber and from the package. In addition, a flow path for evacuating the interior of the package 10 is provided by gaps present between the seal material 20A and the back plate 14 and between the seal material 20A and the frit seal perimeter 22. This allows the interior of the package to be outgassed.

Following the outgassing step the peripheral seal 20 is formed. One of two different embodiments can be used for seal formation. In a first embodiment the seal material 20A is heated and compressed to form the seal 20. In this case the temperature of the reaction chamber can be increased above the softening point and near the melting point of the seal material 20A (e.g., 125° C. to 150° C.) and held for a period of time sufficient to form the peripheral seal 20. In a second embodiment the temperature is maintained well below the melting point of the seal material 20A (e.g., 50° C. to 75° C.) while the seal material 20A is compressed. With either embodiment during seal formation a clamp or weighted fixture can be used to compress the seal material 20A.

Following formation of the peripheral seal 20, the getter material 44 can be activated using an external energy source such as laser energy directed at the getter material 44 or RF energy coupled to the getter material 44.

While the invention has been described with reference to certain preferred embodiments, as will be apparent to those skilled in the art, certain changes and modifications can be made without departing from the scope of the invention as defined by the following claims.

What is claimed is:

1. A method for evacuating and sealing a field emission display package, comprising:

providing a first plate and a second plate;

applying a seal material to the first plate, the seal material comprising indium;

placing the second plate on the seal material to form a space at least partially defined by the seal material, the first plate, and the second plate;

evacuating the space through a flow path provided by non-conformance of the seal material to surfaces on the first or second plates; and heating the seal material during the evacuating step to a temperature of about 125° C. to 150° C.

2. The method as claimed in claim 1 further comprising compressing the seal material during the heating step.

3. The method as claimed in claim 1 wherein the evacuating and heating steps are performed in a reaction chamber at a reduced pressure of between about $1.0\times10^{-5}$ to $1.0\times10^{-8}$ Torr.

4. The method as recited in claim 1 further comprising placing a getter material within the space and activating the getter material following the heating step user laser energy or RF energy.

5. A method for evacuating and sealing a field emission display package, comprising:

providing a first plate and a second plate;

applying a seal material in a peripheral pattern to the first plate, the seal material comprising indium;

placing the second plate on the seal material to form a space at least partially defined by the seal material, the first plate, and the second plate;

evacuating the space through a flow path provided by non-conformance of the seal material to surfaces on the first or second plates;

heating the seal material to a temperature between about 50° C. to 75° C. during the evacuating step; and compressing the seal material during the evacuating step.

6. The method as claimed in claim 5 further comprising applying a wetting agent to the first plate prior to the applying step.

7. A method for evacuating and sealing a field emission display package, comprising:

providing a first plate and a second plate;

forming a seal perimeter on the second plate, the seal perimeter comprising glass frit;

applying a seal material in a peripheral pattern to a surface of the first plate or to the seal perimeter, the seal material comprising indium;

placing the first plate and the second plate together in a reaction chamber with the seal material in contact with the surface and with the seal perimeter, to at least partially define a space;

reducing a pressure within the reaction chamber to evacuate the space through a flow path provided by non-conformance of the seal material to the surface and the seal perimeter; and heating the reaction chamber during the reducing step to a temperature of from about 125° C. to 150° C.

8. The method as claimed in claim 7 further comprising placing a getter material in the space and activating the getter material following the heating step using laser energy or RF energy.

9. The method as claimed in claim 7 and wherein the pressure during the reducing step is between about $1.0\times10^{-5}$ to $1.0\times10^{-8}$ Torr.

10. The method as claimed in claim 7 wherein a baseplate having field emitter sites formed thereon is flip chip mounted to the first plate.

11. The method as recited in claim 7 and wherein the first plate comprises a back plate for the package and the second plate comprises a face plate.

12. A method for evacuating and sealing a field emission display package, comprising:

providing a first plate and a second plate;

applying a seal material in a peripheral pattern to the first plate, the seal material comprising indium;

placing the second plate on the seal material to form a space defined by the seal material, the first plate, and the second plate;

providing a flow path to the space, the flow path formed by non-conformance of the seal material to surfaces on the first plate or the second plate;

placing the first plate and the second plate in a reaction chamber while maintaining the flow path;

reducing a pressure within the reaction chamber to evacuate the space through the flow path;

heating the reaction chamber during the reducing step to a temperature between about 50° C. to 75° C.; and compressing the seal material during the heating step.

13. The method as recited in claim 12 further comprising placing a getter material within the space and activating the getter material following the compressing step user laser energy or RF energy.

14. A method for evacuating and sealing a field emission display package, comprising:

providing a first plate and a second plate;

applying a seal material to the first plate in a peripheral pattern, the seal material comprising indium;

placing the second plate on the seal material to form a space defined by the seal material, the first plate, and the second plate;

placing a getter within the space;

providing a flow path to the space, the flow path formed by non-conformance of the seal material to surfaces on the first plate or the second plate;

evacuating the space through the flow path; and following the evacuating step, activating the getter using laser energy or RF energy.

15. The method as claimed in claim 14 further comprising heating the seal material to a temperature between about 125° C. to 150° C. during the evacuating step.

16. The method as claimed in claim 14 further comprising compressing and heating the seal material during the evacuating step to a temperature of from 50° C. to 75° C.

* * * * *